United States Patent [19]

van Nes

[11] 4,193,713

[45] Mar. 18, 1980

[54] METHOD AND APPARATUS FOR COVERING OR FILLING A TRENCH ON THE SEA BOTTOM

[75] Inventor: Hadriaan van Nes, Spydeberg, Norway

[73] Assignee: A/S Akers Mek. Versted, Oslo, Norway

[21] Appl. No.: 912,750

[22] Filed: Jun. 5, 1978

[51] Int. Cl.[2] ..... B63B 35/04

[52] U.S. Cl. ..... 405/159

[58] Field of Search ..... 61/724, 106, 107, 113, 61/43; 405/159, 161, 158, 164

[56] References Cited

U.S. PATENT DOCUMENTS

| | | | |
|---|---|---|---|
| 3,673,808 | 7/1972 | Volbeda | 61/72.4 |
| 3,890,741 | 6/1975 | De Koning et al. | 61/72.4 |

*Primary Examiner*—Ramon S. Britts

*Attorney, Agent, or Firm*—Watson, Cole, Grindle & Watson

[57] ABSTRACT

Disclosed are a method and apparatus for the covering and filling of a trench used for an oil and/or gas conduit on the sea bottom which utilize a surface vessel retained in position over the trench by means of positioning equipment while filling material is released downwardly towards the trench and sea bottom from the vessel. The method comprises supplying filling material, heavily mixed with water, to the surface vessel from a store or the like via a preferably floating hose, reducing the water content of the filling material in a separator aboard the vessel, and conveying the filling material thus treated downwardly to the trench and sea bottom via a tube or the like whose mouth is retained adjacent to the trench and the sea bottom.

4 Claims, 2 Drawing Figures

METHOD AND APPARATUS FOR COVERING OR FILLING A TRENCH ON THE SEA BOTTOM

Figure 1:
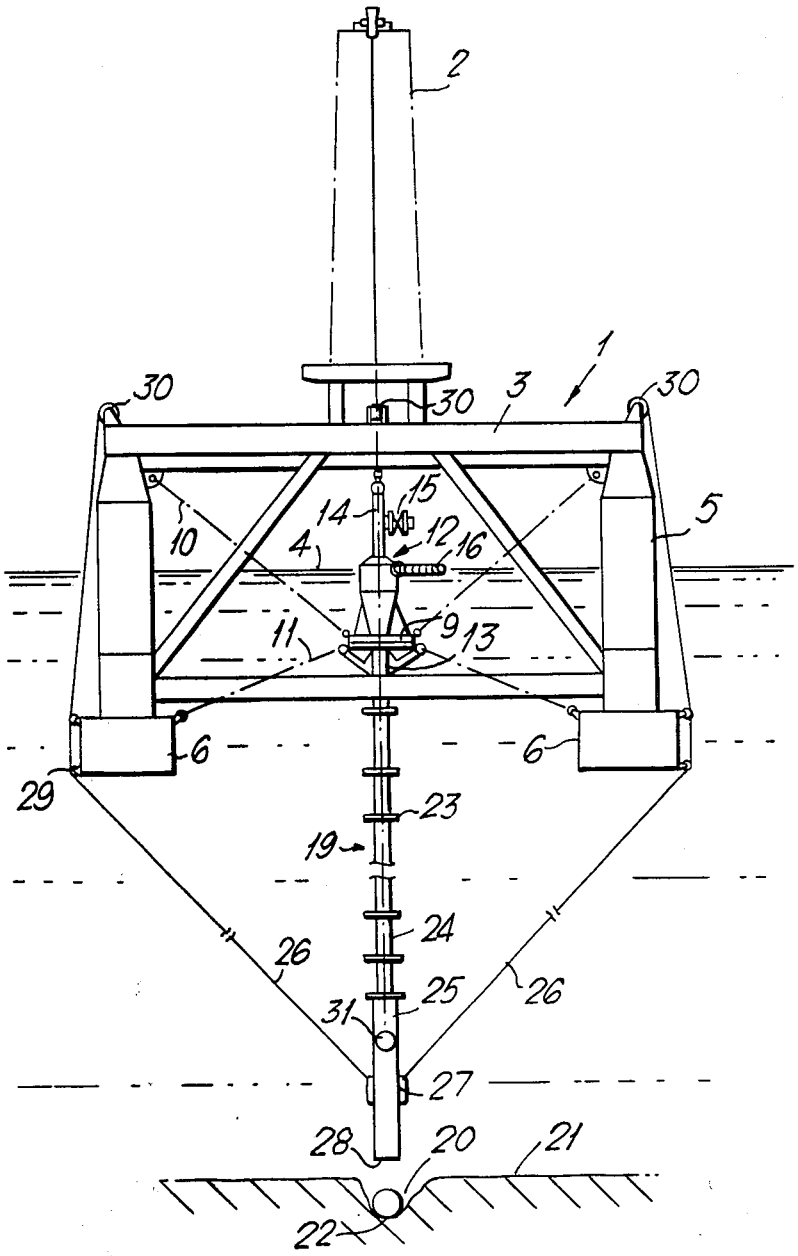

The invention relates to a method and apparatus for use in connection with the covering or filling of a trench for an oil and/or gas conduit on the sea bottom; In the method and apparatus, a surface vessel is used which is retained in position over the trench by means of positioning equipment while filling material is released downwardly from the vessel towards the trench and sea bottom.

It is previously known to fill trenches of the type mentioned above by using barges on the surface of the sea which utilize bottom hatches to empty sand or other covering material downwardly over the trench after the vessel has been moved into position thereover by means of positioning instruments.

As is apparent, when trenches are covered or filled at considerable depths such as 100–200 meters or more, sand emptied from barges on the surface descends through the water to the sea bottom and tends to spread over considerable areas on both sides of the trench so that unduly large amounts of covering material are required to fill the trench. Generally, barges of the kind specified are filled with sand from the sea bottom in areas where the depth does not substantially exceed about 30 meters, the normal maximum working depth for pumping sand up to the surface of the sea. Such areas, for instance for central parts of the North Sea, will tend to lie 6–8 hours sailing time from the trench. For this reason, the prior art uncontrolled covering methods are very expensive and time consuming.

Furthermore, every time a load has to be emptied, it requires considerable time for the barge to reach its correct position above the trench or filling place and relatively considerable deviations from the proper position must be expected, especially in unfavourable weather conditions.

Clearly, therefore, the prior art methods waste a considerable amount of time and are expensive, in addition to the fact that they consume a large amount of filling material.

It is therefore an object of the present invention to provide a method and an apparatus for the performance of the method of the type specified which obviates the aforementioned disadvantages.

One embodiment of the invention provides a filling apparatus which supplies the filling material to the trench at a small distance above the sea bottom. This ensures that the entirety of the material supplied is utilized in filling the trench. The material is supplied via a relatively large tube which conveys the filling material down from the surface of the sea with a consistency which is readily floatable and without appreciable quantities of water. The top of the tube comprises a cyclone separator for separating water from the filling material which is pumped heavily mixed with water via a floating hose from a barge situated at a suitable distance from the cyclone. The cyclone separator is used to thicken the filling material, which must be substantially diluted with water, due to its long conveyance in the tube from the barge to the vessel. If a slurried material of this kind were to be used for filling, it would have a high velocity directly in the descending pipe as it falls to the sea bottom and would in that condition tend to float undesirably far out at the side of the discharge aperture of the pipe. The cyclone separator is therefore needed to reduce the speed of fall of the material by separating the majority of water before the material is supplied to the descending tube.

The material therefore slowly seeps downwardly through the tube and overflows out at the sides of the pipe discharge to an insignificant extent. A suitable number of barges supply the filling material to the operational area and are coupled to and uncoupled from the hose in the usual manner at sea.

The tube and cyclone separator are preferably disposed on a vessel, preferably a H-3 semi-submersible platform having the necessary satisfactory properties with regard to heaving and rolling movements. Disposed below the main deck of the platform is a smaller platform on which the cyclone separator is located. A floating conveying hose is connected to the cyclone separator and the discharge for the separated filling material is connected to a tube extending downwardly towards the sea bottom.

The H-3 platform or the vessel has advanced positioning equipment so that at any time the vessel can, by means of its own propellers and engines, maintain the required position above the trench or area to be filled. The vessel can therefore be moved without the use of anchors on the sea bottom. Positioning is moreover performed in the conventional, known manner by signal transmitters disposed along the path to be followed.

The bottom or discharge part of the tube is connected via a suitable number of wires or cables, for instance, to a winch which is disposed at each of the four corners of the vessel and can be partially or wholly controlled via an electronic data processing system. The winches haul in or pay out the respective cables in such a way that the tube discharge can be moved precisely into the required position at anytime. This is observed and controlled from the vessel via a transponder disposed at the tube discharge.

This system for controlling the tube is used more particularly in heavy seas to eliminate the inertia of displacement of the vessel.

The bottom portion of the tube is arranged telescopically so that the distance of the discharge end from the sea bottom or filling area can be adapted at any time to the prevailing conditions.

Figure 2:
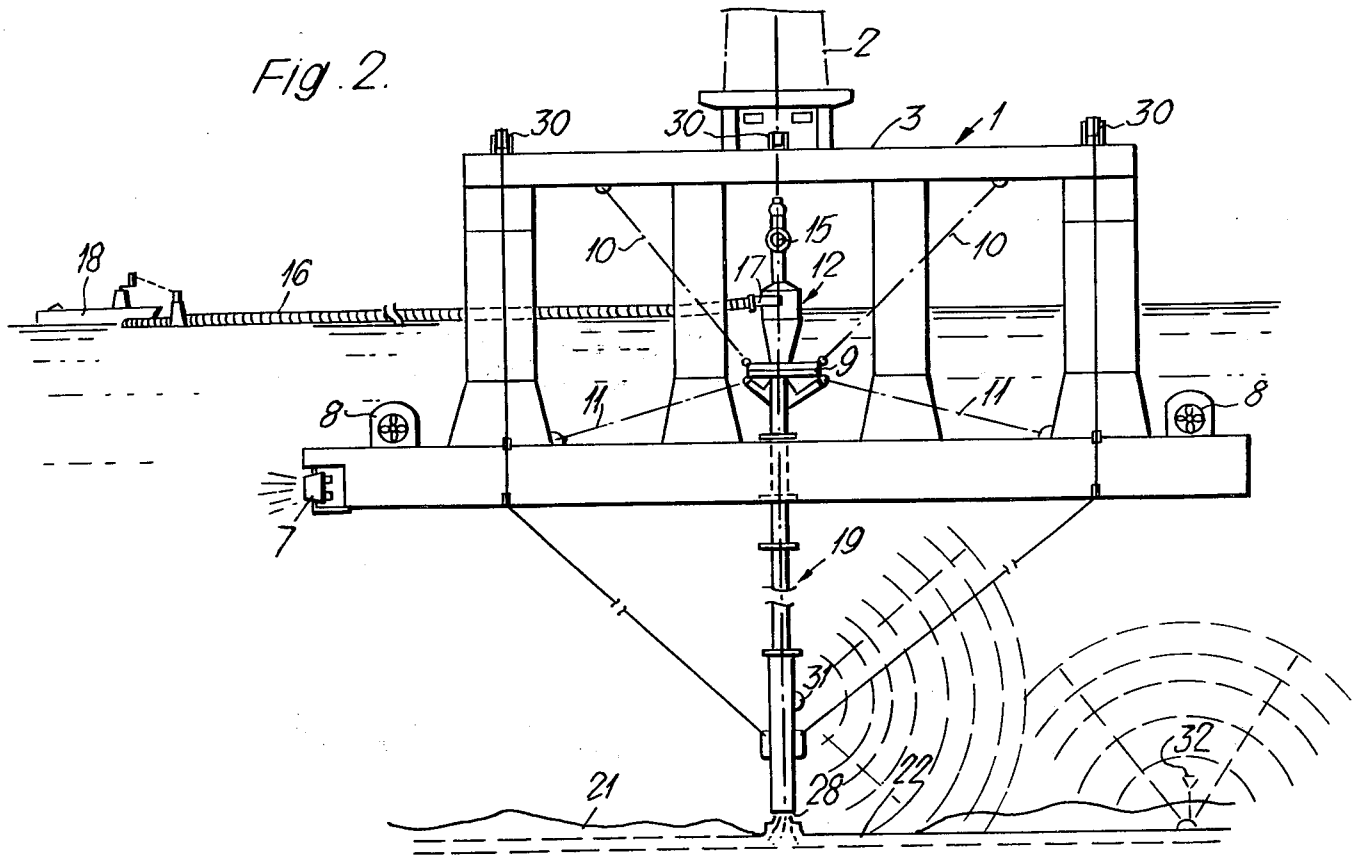

The invention will be described in greater detail by means of examples thereof and with reference to the drawings wherein:

FIG. 1 illustrates a construction according to the invention suspended in a semi-submersible vessel, viewed in the direction of the bow, and FIG. 2 is a side elevation of the construction of FIG. 1.

FIG. 1 illustrates in general a semi-submersible platform 1, preferably of an H-3 type, in the submerged working position. The platform's drilling or hoisting tower is designated 2, the platform's main deck 3 and the surface of the sea 4. The columns of the platform have the reference 5, pontoons the reference 6, propulsion machinery the reference 7, and lateral or thrust propellers the reference 8.

A supporting frame 9 is suspended in the top steel structures of the platform under the main deck by means of wires or stays 10, while stays 11 rigidify the supporting frame 9 against lateral displacement. The supporting frame 9 forms the base or foundation for a cyclone separator 12 which is demountably disposed on the supporting frame. The cyclone separator 12 is preferably of the type which separates heavy particles from a stream of liquid, the particles generally following the inner conical periphery of the cyclone separator in the downward direction and leaving the cyclone separator at the bottom portion 13, while the liquid leaves the cyclone separator in its top portion via discharge tube 14 and a valve 15 adapted to throttle the water flowing out to determine and vary the water content of the filling material. The filling material, heavily mixed with water, is supplied to the cyclone separator from floating conveying hose 16 via inlet spigot 17. At its opposite end, the conveying hose 16 is coupled to the pumping installation (not shown) of a barge 18.

From the discharge spigot 13 of the cyclone separator 12, a generously dimensioned tube 19 extends downwardly towards trench 20 which is to be covered and which has previously been dug out of the sea bottom 21 to protect conduit 22. The tube 19 is divided up into sections 24 by means of flanges 23 or the like for adaptation to the depth as the covering of the trench progresses.

To enable relatively small adjustments to be made to the depth of the bottom end portion of the tube 19, its bottom section is preferably telescopic so that it can be moved vertically by means of a number of wires or cables 26 which are connected at a point 27 on the discharge portion 28 of the tube 19 and extend upwardly and outwardly to the pontoons 6 and then via rollers or the like 29 to winches 30, preferably disposed on the main deck 3. Of course, the winches 30 can be of the underwater type and disposed directly on the pontoons or at some other suitable location. The wires 26 also perform another important function, namely to control the discharge 28 of the tube 19 that it is always at the required position above the trench 20.

Disposed on the bottom portion of the tube 19 or closely adjacent thereto is a signal receiver 31 which is directed towards the trench 20 in the area around the tube spigot 28 and enables the operators on the mother vessel to retain control at all times, if necessary via electronic data processing systems, over the filling process. A number of signal transmitters 32 are disposed along the line of the trench 20, so that the position of the vessel in relation to the trench can be corrected at any time.

I claim:

1. A method of covering and filling a trench for an oil and/or gas conduit on the sea bottom, using a surface vessel which is retained in position over the trench by means of positioning equipment, while filling material is released downwardly towards the trench and sea bottom from the vessel, comprising supplying filling material heavily mixed with water to the surface vessel from a store via a hose, reducing the amount of water with the filling material in a separator aboard the vessel, and conveying the filling material downwardly to the trench and sea bottom via a tube whose mouth is retained adjacent to the trench and sea bottom.

2. An apparatus for covering and filling a trench for an oil and/or gas line on the sea bottom comprising a vessel, a separator attached to the vessel and having an inlet for filling material mixed with water, a top discharge for water, and a bottom discharge for the dewatered filling material, a tube attached by one end to the bottom discharge of the separator and attached at its other end to a number of wires extending in different directions upwardly to rollers and winches in the vessel, and means for determining the position of the bottom end of the tube in relation to conduit and signal transmitters disposed therealong.

3. An apparatus according to claim 2, further including means for the complete or partial automatic control of the winches for positioning the discharge of the tube.

4. An apparatus according to claim 2 or 3, wherein the top discharge of the separator has a flowrate control device.

* * * * *